US009524677B2

(12) United States Patent
Park et al.

(10) Patent No.: US 9,524,677 B2
(45) Date of Patent: Dec. 20, 2016

(54) DISPLAY PANEL DRIVER, METHOD OF DRIVING DISPLAY PANEL USING THE SAME AND DISPLAY APPARATUS HAVING THE SAME

(71) Applicant: Samsung Display Co., Ltd., Yongin, Gyeonggi-do (KR)

(72) Inventors: Jin-Woo Park, Yongin (KR); Su-Min Yang, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 78 days.

(21) Appl. No.: 14/074,304

(22) Filed: Nov. 7, 2013

(65) Prior Publication Data

US 2014/0313235 A1 Oct. 23, 2014

(30) Foreign Application Priority Data

Apr. 22, 2013 (KR) ..... 10-2013-0044459

(51) Int. Cl.
*G09G 5/10* (2006.01)
*G09G 3/32* (2016.01)

(52) U.S. Cl.
CPC ..... *G09G 3/3291* (2013.01); *G09G 3/325* (2013.01); *G09G 3/3225* (2013.01); *G09G 2300/0814* (2013.01); *G09G 2320/0285* (2013.01); *G09G 2320/045* (2013.01)

(58) Field of Classification Search
USPC ..... 345/690, 691, 63, 89, 207, 601, 694, 92, 345/204, 77, 76, 83
See application file for complete search history.

(56) References Cited

U.S. PATENT DOCUMENTS

| | | | | |
|---|---|---|---|---|
| 7,474,280 | B2 * | 1/2009 | Kawahara | 345/63 |
| 7,847,771 | B2 * | 12/2010 | Maruyama et al. | 345/89 |
| 2005/0270262 | A1 * | 12/2005 | Oh | 345/89 |
| 2007/0132895 | A1 * | 6/2007 | Shen | G09G 3/2007 349/1 |
| 2008/0246780 | A1 * | 10/2008 | Cho | G02F 1/133602 345/690 |
| 2009/0147032 | A1 | 6/2009 | Kim | |
| 2011/0057959 | A1 * | 3/2011 | Park | G09G 3/3648 345/690 |
| 2011/0234625 | A1 * | 9/2011 | Irie | G09G 3/3648 345/601 |
| 2012/0038684 | A1 * | 2/2012 | Ryu | 345/690 |
| 2012/0062623 | A1 | 3/2012 | Kim et al. | |
| 2012/0106901 | A1 * | 5/2012 | Wu | 385/88 |

(Continued)

FOREIGN PATENT DOCUMENTS

| | | | |
|---|---|---|---|
| KR | 10-2009-0058788 | A | 6/2009 |
| KR | 10-2012-0028004 | A | 3/2012 |
| KR | 10-2012-0090635 | A | 8/2012 |

*Primary Examiner* — Thuy Pardo
(74) *Attorney, Agent, or Firm* — Robert E. Bushnell, Esq.

(57) ABSTRACT

A display panel driver that includes a compensating value generating part, a compensating lookup table and a compensating part. The compensating value generating part generates an offset and a compensating grayscale based on luminances of pixels of a display panel. The compensating lookup table stores the offset and the compensating grayscale. The compensating part compensates an input grayscale of the pixel to generate a data signal using the compensating lookup table.

17 Claims, 6 Drawing Sheets

(56) References Cited

U.S. PATENT DOCUMENTS

| | | | | |
|---|---|---|---|---|
| 2012/0200608 | A1* | 8/2012 | Kim | G09G 3/3258 345/690 |
| 2012/0206502 | A1* | 8/2012 | Jung et al. | 345/690 |
| 2012/0223921 | A1* | 9/2012 | Ohara | G09G 3/3651 345/204 |
| 2012/0299987 | A1* | 11/2012 | Yamazaki | G09G 3/006 345/694 |
| 2013/0016082 | A1* | 1/2013 | Coley et al. | 345/207 |
| 2013/0069855 | A1* | 3/2013 | Nakanishi | G09G 3/3655 345/92 |
| 2013/0342585 | A1* | 12/2013 | Chun | G09G 3/3208 345/690 |
| 2014/0118426 | A1* | 5/2014 | Chun et al. | 345/691 |
| 2014/0313235 | A1* | 10/2014 | Park | G09G 3/3291 345/690 |

* cited by examiner

DISPLAY PANEL DRIVER, METHOD OF DRIVING DISPLAY PANEL USING THE SAME AND DISPLAY APPARATUS HAVING THE SAME

CLAIM PRIORITY

This application makes reference to, incorporates the same herein, and claims all benefits accruing under 35 U.S.C. §119 from an application earlier filed in the Korean Intellectual Property Office on 22 Apr. 2013 and there duly assigned Serial No. 10-2013-0044459.

BACKGROUND OF THE INVENTION

1. Field of the Invention

Example embodiments of the inventive concept relate generally to a display apparatus.

2. Description of the Related Art

Generally, a display apparatus includes a display panel and a display panel driver. The display panel includes a plurality of gate lines, a plurality of data lines and a plurality of pixels. The display panel driver includes a controller, a gate driver and a data driver.

The above information disclosed in this Related Art section is only for enhancement of understanding of the background of the invention and therefore it may contain information that does not form the prior art that is already known to a person of ordinary skill in the art.

SUMMARY OF THE INVENTION

Some example embodiments provide a display panel driver capable of efficiently using a storage area of the lookup table to compensate a stain.

Some example embodiments also provide a method of driving a display panel using the display panel driver.

Some example embodiments still also provide a display apparatus including the display panel driver.

According to some example embodiments, a display panel driver includes a compensating value generating part, a compensating lookup table and a compensating part. The compensating value generating part generates an offset and a compensating grayscale based on luminances of pixels of a display panel. The compensating lookup table stores the offset and the compensating grayscale. The compensating part compensates an input grayscale of the pixel to generate a data signal using the compensating lookup table.

In example embodiments, the offset may be set based on a maximum luminance of the pixels and a minimum luminance of the pixels.

In example embodiments, when the maximum luminance is LMAX, the minimum luminance is LMIN and the number of bits of the compensating lookup table is X, $$\text{OFFSET} = \frac{\frac{LMIN}{LMAX} \times (2^X - 1)}{1 - \frac{LMIN}{LMAX}}.$$

In example embodiments, the compensating grayscale of a first pixel may be set based on the offset, a minimum luminance of the pixels and a luminance of the first pixel.

In example embodiments, when the offset is OFFSET, the luminance of the first pixel is L1, the minimum luminance is LMIN and the number of bits of the compensating lookup table is X, the compensating grayscale (COMP1) of the first pixel may be $$COMP1 = \frac{(2^X - 1 + OFFSET) \times LMIN}{L1} - \text{OFFSET}.$$

In example embodiments, when the input grayscale is IGS, the offset is OFFSET, the compensating grayscale is COMP and the number of bits of the compensating lookup table is X, a grayscale (OGS) of the data signal may be $$OGS = IGS \times \frac{COMP + \text{OFFSET}}{2^X - 1 + \text{OFFSET}}.$$

In example embodiments, the compensating value generating part may generate a first offset and a first compensating value based on first pixels having a first color, a second offset and a second compensating value based on second pixels having a second color, a third offset and a third compensating value based on third pixels having a third color.

According to some example embodiments, a display apparatus includes a display panel and a display panel driver. The display panel includes a plurality of gate lines, a plurality of data lines and a plurality of pixels connected to the gate lines and the data lines. The display panel driver includes a compensating value generating part including a compensating value generating part generating an offset and a compensating grayscale based on luminances of the pixels, a compensating lookup table storing the offset and the compensating grayscale and a compensating part compensating an input grayscale of the pixel to generate a data signal using the compensating lookup table.

In example embodiments, the pixel may include a switching transistor including a control electrode connected to the gate line, an input electrode connected to the data line and an output electrode connected to a first node, a driving transistor including a control electrode connected to the first node, an input electrode connected to a second node and an output electrode connected to a first electrode of an organic light emitting element, a bias transistor including a control electrode to which a bias voltage may be applied, an input electrode to which a high power voltage may be applied and an output electrode connected to the second node, a first capacitor including a first end to which the high power voltage may be applied and a second end connected to the first node, a second capacitor including a first end to which the high power voltage may be applied and a second end connected to the control electrode of the bias transistor and the light organic light emitting element including the first electrode connected to the output electrode of the driving transistor and a second electrode to which a low power voltage may be applied.

In example embodiments, the offset may be set based on a maximum luminance of the pixels and a minimum luminance of the pixels.

In example embodiments, when the maximum luminance is LMAX, the minimum luminance is LMIN and the number of bits of the compensating lookup table is X, $$\text{OFFSET} = \frac{\frac{LMIN}{LMAX} \times (2^X - 1)}{1 - \frac{LMIN}{LMAX}}.$$

In example embodiments, the compensating grayscale of a first pixel may be set based on the offset, a minimum luminance of the pixels and a luminance of the first pixel.

In example embodiments, when the offset is OFFSET, the luminance of the first pixel is L1, the minimum luminance is LMIN and the number of bits of the compensating lookup table is X, the compensating grayscale (COMP1) of the first pixel may be $$COMP1 = \frac{(2^X - 1 + \text{OFFSET}) \times LMIN}{L1} - \text{OFFSET}.$$

In example embodiments, when the input grayscale is IGS, the offset is OFFSET, the compensating grayscale is COMP and the number of bits of the compensating lookup table is X, a grayscale (OGS) of the data signal may be $$OGS = IGS \times \frac{COMP + \text{OFFSET}}{2^X - 1 + \text{OFFSET}}.$$

In example embodiments, the compensating value generating part may generate a first offset and a first compensating value based on first pixels having a first color, a second offset and a second compensating value based on second pixels having a second color, a third offset and a third compensating value based on third pixels having a third color.

According to some example embodiments, a method of driving a display panel includes generating an offset and a compensating grayscale based on luminances of pixels of a display panel, storing the offset and the compensating grayscale and compensating an input grayscale of the pixel to generate a data signal using the compensating lookup table In example embodiments, the offset may be set based on a maximum luminance of the pixels and a minimum luminance of the pixels.

In example embodiments, the compensating grayscale of a first pixel may be set based on the offset, a minimum luminance of the pixels and a luminance of the first pixel.

In example embodiments, when the input grayscale is IGS, the offset is OFFSET, the compensating grayscale is COMP and the number of bits of the compensating lookup table is X, a grayscale (OGS) of the data signal may be $$OGS = IGS \times \frac{COMP + \text{OFFSET}}{2^X - 1 + \text{OFFSET}}.$$

In example embodiments, the storing the offset and the compensating grayscale may include generating a first offset and a first compensating value based on first pixels having a first color, generating a second offset and a second compensating value based on second pixels having a second color and generating a third offset and a third compensating value based on third pixels having a third color.

According to the display panel driver, the method of driving the display panel using the display panel driver and the display apparatus including the display panel driver, a compensating lookup table stores an offset and a compensating grayscale so that a storage area of the compensating lookup table may be efficiently used and a compensating resolution may be improved. Thus, a stain of the display panel may be effectively compensated.

Effectiveness of the present inventive concept is not limited to the above effectiveness. Not mentioned effectiveness of the present inventive concept may be clearly understood to those skilled in the art.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE EMBODIMENTS

Figure 1:
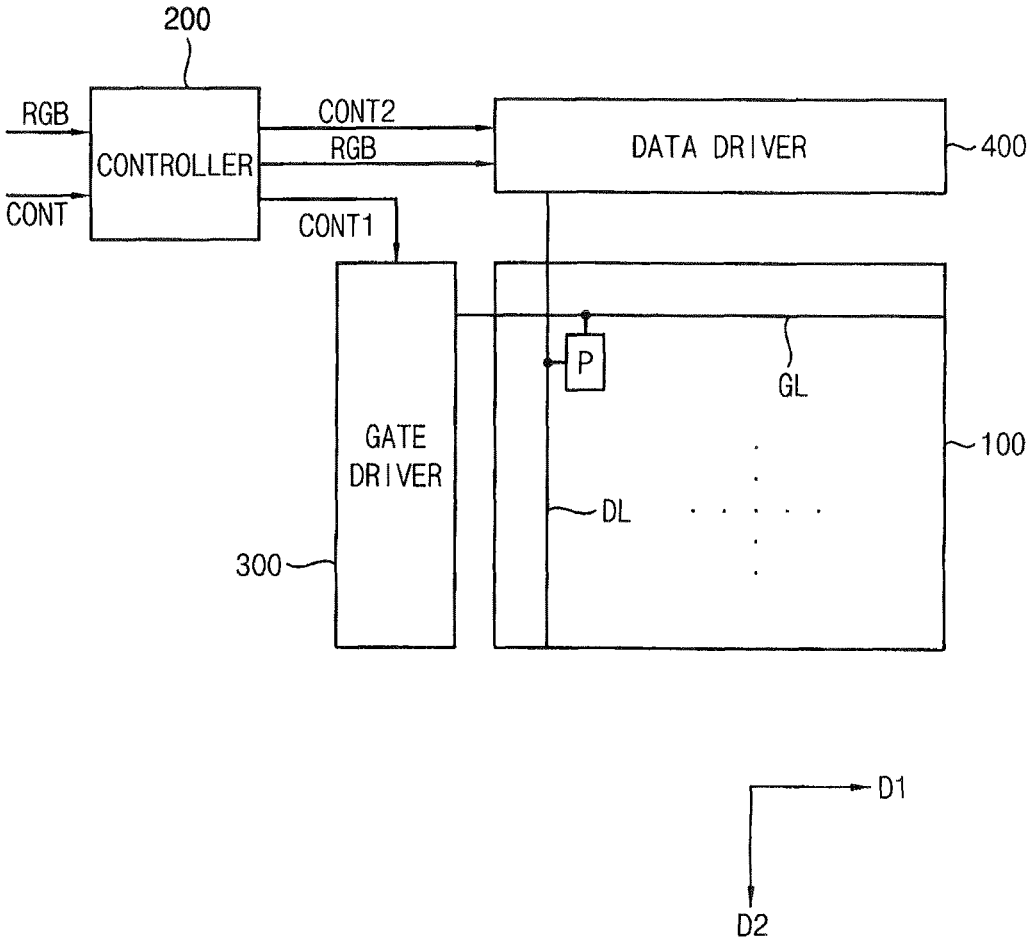
FIG. 1 is a block diagram illustrating a display apparatus according to example embodiments.

The example embodiments are described more fully hereinafter with reference to the accompanying drawings. The inventive concept may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Generally in a display, a pixel includes a plurality of transistors, a storage capacitor and an organic light emitting element. Due to variation of threshold voltages of the transistors, luminance of the pixels may be different from each other so that a stain may be generated.

When a lookup table to compensate for the stain is used, only a part of a storage area of the lookup table is used so that the storage area of the lookup table is inefficiently used.

FIG. 1 is a block diagram illustrating a display apparatus according to example embodiments.

Referring to FIG. 1, the display apparatus includes a display panel 100 and a display panel driver. The display panel driver includes a controller 200, a gate driver 300 and a data driver 400. For example, the display apparatus may be an organic light emitting display apparatus. Alternatively, the display apparatus may be a liquid crystal display apparatus. Alternatively, the display apparatus may be a plasma display apparatus.

The display panel 100 includes a plurality of gate lines GL, a plurality of data lines DL and a plurality of pixels P electrically connected to the gate lines GL and the data lines DL.

The gate lines GL extend in a first direction D1. The data lines DL extend in a second direction D2 crossing the first direction D1.

The pixels P may be disposed in a matrix form. A structure of the pixels P may be explained referring to FIG. 2 in detail.

The controller 200 receives input image data RGB and an input control signal CONT from an external apparatus (not shown). For example, the input image data RGB may include red image data, green image data and blue image data. The input image control signal CONT may include a master clock signal and a data enable signal. The input image control signal CONT may further include a vertical synchronizing signal and a horizontal synchronizing signal.

The controller 200 generates a first control signal CONT1 and a second control signal CONT2 based on the input image data RGB and the input control signal CONT.

The controller 200 generates the first control signal CONT1 for controlling an operation of the gate driver 300 based on the input control signal CONT and outputs the first control signal CONT1 to the gate driver 300. The first control signal CONT1 may include a vertical start signal and a gate clock signal.

The controller 200 generates the second control signal CONT2 for controlling an operation of the data driver 400 based on the input control signal CONT, and outputs the second control signal CONT2 to the data driver 400. The second control signal CONT2 may include a horizontal start signal and a load signal.

The controller 200 outputs the input image data RGB to the data driver 400.

The gate driver 300 generates gate signals to drive the gate lines GL in response to the first control signal CONT1 received from the controller 200. The gate driver 300 sequentially outputs the gate signals to the gate lines GL.

The gate driver 300 may be directly mounted on the display panel 100, or may be connected to the display panel 100 as a tape carrier package ("TCP") type. Alternatively, the gate driver 300 may be integrated on a peripheral region of the display panel 100.

The data driver 400 receives the second control signal CONT2 and the input image data RGB from the controller 200. The data driver 400 compensates grayscales of the input image data RGB to generate data signals. The data driver 400 outputs the data signals to the data lines DL. For example, the data signal may be a pulse width modulation signal.

The data driver 400 may be directly mounted on the display panel 100, or be connected to the display panel 100 in a TCP type. Alternatively, the data driver 400 may be integrated on the peripheral region of the display panel 100.

Figure 3:
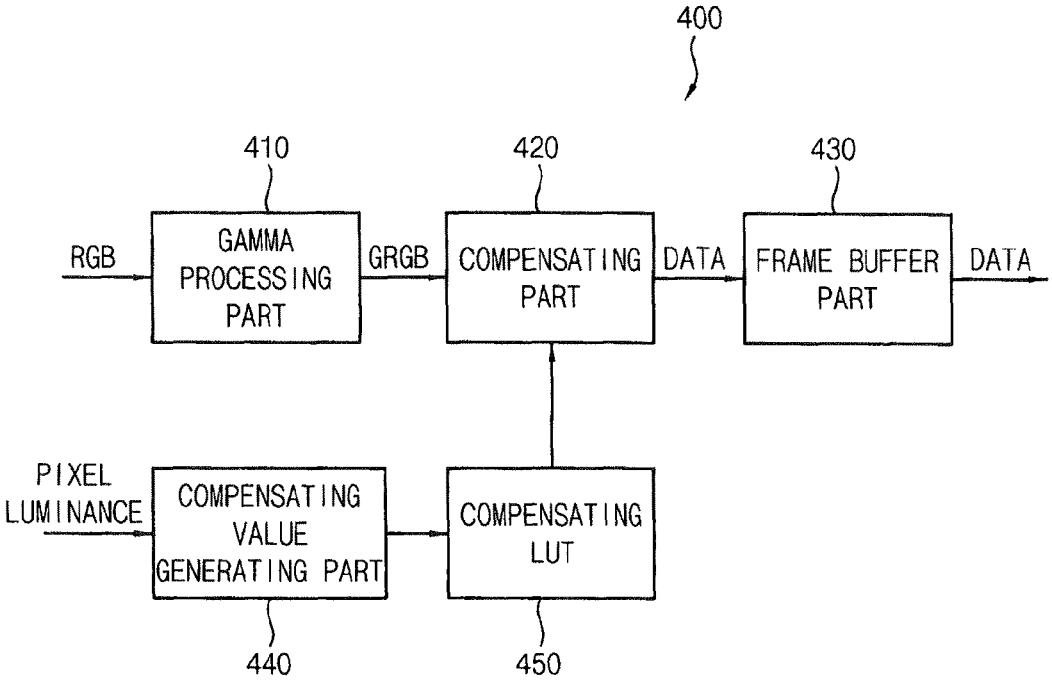
FIG. 3 is a block diagram illustrating a data driver of FIG. 1.

A structure of the data driver 400 may be explained referring to FIG. 3 in detail.

Figure 2:
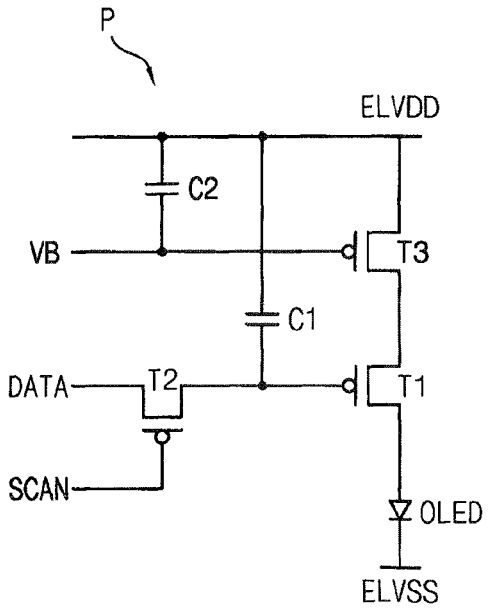
FIG. 2 is a circuit diagram illustrating a pixel of FIG. 1.

FIG. 2 is a circuit diagram illustrating the pixel P of FIG. 1.

Referring to FIGS. 1 and 2, the pixel P includes a switching transistor T2, a driving transistor T1, a bias transistor T3, a first capacitor C1, a second capacitor C2 and an organic light emitting element OLED.

The switching transistor T2 includes a control electrode connected to the gate line GL to which the gate signal SCAN may be applied, an input electrode connected to the data line DL to which the data signal DATA may be applied and an output electrode connected to a control electrode of the driving transistor T1.

The switching transistor T2 may be turned on and turned off in response to the gate signal SCAN. When the switching transistor T2 may be turned on, the data signal DATA may be applied to the control electrode of the driving transistor T1. For example, the data signal DATA may be a pulse width modulation signal.

The control electrode of the switching transistor T2 may be a gate electrode. The input electrode of the switching transistor T2 may be a source electrode. The output electrode of the switching transistor T2 may be a drain electrode.

In the present example embodiment, the switching transistor T2 may be a P-type transistor. The switching transistor T2 may be turned on when the gate signal has a low level. Alternatively, the switching transistor T2 may be an N-type transistor.

The driving transistor T1 includes a control electrode connected to the output electrode of the switching transistor T2, an input electrode connected to an output electrode of the bias transistor T3 and an output electrode connected to a first electrode of the organic light emitting element OLED.

The pixel P may be driven in a digital driving method, the driving transistor T1 may be operated in a linear region. Thus, the driving transistor T1 may be turned on and turned off in response to a voltage at the control electrode of the driving transistor T1. When the driving transistor T1 may be turned on, a high power voltage ELVDD which passes through the bias transistor T3 may be applied to the first electrode of the organic light emitting element OLED. A turn on duration of the driving transistor T1 may be controlled according to on-duty of the pulse width modulation signal applied to the control electrode.

The control electrode of the driving transistor T1 may be a gate electrode. The input electrode of the driving transistor T1 may be a source electrode. The output electrode of the driving transistor T1 may be a drain electrode.

In the present example embodiment, the driving transistor T1 may be a P-type transistor. The driving transistor T1 may be turned on when the voltage at the control electrode of the driving transistor T1 is less than a turn on voltage of the first driving transistor T1.

The bias transistor T3 includes a control electrode to which a bias voltage VB may be applied, an input electrode to which the high power voltage ELVDD may be applied and an output electrode connected to the input electrode of the driving transistor T1.

The bias transistor T3 may be operated in a saturation region. The bias transistor T3 controls an output current of the bias transistor T3 based on the bias voltage VB. The output current of the bias transistor T3 may be maintained in a uniform level so that the organic light emitting element OLED may be prevented from deterioration.

The control electrode of the bias transistor T3 may be a gate electrode. The input electrode of the bias transistor T3 may be a source electrode. The output electrode of the bias transistor T3 may be a drain electrode.

In the present example embodiment, the bias transistor T3 may be a P-type transistor. Alternatively, the bias transistor T3 may be an N-type transistor.

The first capacitor C1 includes a first end to which the high power voltage ELVDD may be applied and a second end connected to the control electrode of the driving transistor T1.

The first capacitor C1 may be a storage capacitor. The first capacitor C1 maintains the voltage at the control electrode of the driving transistor T1.

The second capacitor C2 includes a first end to which the high power voltage ELVDD may be applied and a second end connected to the control electrode of the bias transistor T3.

The organic light emitting element OLED includes the first electrode connected to the output electrode of the driving transistor T1 and a second electrode to which a low power voltage ELVSS may be applied.

When a difference between a voltage at the first electrode and a voltage at the second electrode is equal to or greater than a threshold voltage, the organic light emitting element OLED may be turned on. When the difference between the voltage at the first electrode and the voltage at the second electrode is less than the threshold voltage, the organic light emitting element OLED may be turned off.

Figure 4:
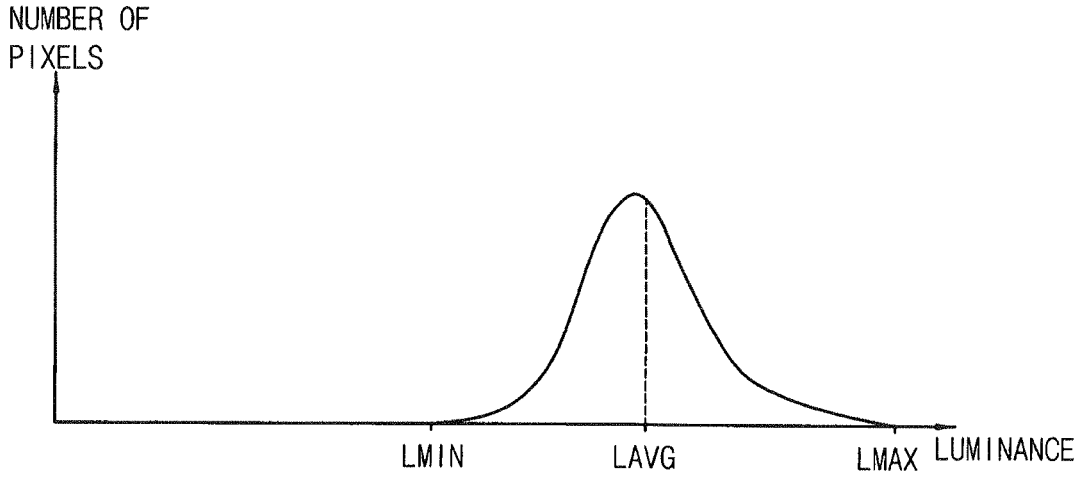
FIG. 4 is a graph illustrating a luminance distribution of the pixel of FIG. 1.

FIG. 3 is a block diagram illustrating the data driver 400 of FIG. 1. FIG. 4 is a graph illustrating a luminance distribution of the pixel P of FIG. 1.

Referring to FIGS. 1 to 4, the data driver 400 includes a gamma processing part 410, a compensating part 420, a frame buffer part 430, a compensating value generating part 440 and a compensating lookup table 450.

The gamma processing part 410 receives the input image data RGB. The gamma processing part 410 operates a gamma conversion to the input image data RGB to generate a gamma image data GRGB. The gamma processing part 410 outputs the gamma image data GRGB to the compensating part 420. For example, a gamma value of the gamma processing part 410 may be about 2.2.

The compensating part 420 receives the gamma image data GRGB from the gamma processing part 410. The compensating part 420 compensates the gamma image data GRGB to generate the data signal DATA using the compensating lookup table 450. The compensating part 420 outputs the data signal DATA to the frame buffer 430.

The compensating part 420 compensates the stain due to a difference of the luminances of the pixels of the display panel 100. For example, the compensating part 420 may compensate the stain due to a difference of the luminances of the pixels according to the variation of threshold voltages of the bias transistors T3.

The frame buffer part 430 receives the data signal DATA from the compensating part 420. The frame buffer part 430 buffers the data signal DATA and outputs the data signal DATA to the display panel 100.

The compensating value generating part 440 receives a luminance histogram of the pixels of the display panel 100. The compensating value generating part 440 generates an offset and a compensating grayscale based on the luminance histogram of the pixels.

Test image data are inputted to the display panel 100 and the luminance of each pixel may be measured to determine the luminance histogram of the pixels of the display panel 100. For example, the test image data may represent a full white image.

FIG. 4 illustrates an example of the luminance histogram of the pixels. The graph in FIG. 4 represents the luminances of each pixel when the same grayscale is applied to all of the pixels of the display panel 100. The luminances of the pixels are distributed between a minimum luminance LMIN and a maximum luminance LMAX corresponding to the same grayscale. The pixels have an average luminance LAVG corresponding to the same grayscale.

The compensating lookup table 450 stores the offset and the compensating grayscale.

The offset may be set based on the maximum luminance LMAX of the pixels and the minimum luminance LMIN of the pixels. For example, the offset may be commonly applied to all of the pixels.

The compensating grayscale may be set based on the offset, the minimum luminance LMIN of the pixels and the luminance of the pixel. The compensating grayscales of the pixels may be varied according to the luminance of the pixel.

When the maximum luminance of the pixels is LMAX, the minimum luminance of the pixels is LMIN and the number of bits of the compensating lookup table 450 is X, the offset commonly applied to all of the pixels of the display panel 100 may be determined as Equation 1. For example, the offset may be rounded off to the nearest integer.

$$\text{OFFSET} = \frac{\frac{LMIN}{LMAX} \times (2^X - 1)}{1 - \frac{LMIN}{LMAX}} \quad \text{[Equation 1]}$$

When the offset is OFFSET, a luminance of a first pixel is L1, the minimum luminance of the pixels is LMIN and the number of bits of the compensating lookup table 450 is X, the compensating grayscale COMP1 of the first pixel may be determined as Equation 2. For example, the compensating grayscale COMP1 may be rounded off to the nearest integer.

$$COMP1 = \frac{(2^X - 1 + \text{OFFSET}) \times LMIN}{L1} - \text{OFFSET} \quad \text{[Equation 2]}$$

The compensating part 420 compensates the gamma image data GRGB to generate the data signal DATA using the compensating lookup table 450. The grayscale of the gamma image data GRGB may be referred to an input grayscale IGS. The grayscale of the data signal DATA may be referred to an output grayscale OGS.

When the input grayscale is IGS, the offset is OFFSET, the compensating grayscale is COMP and the number of bits of the compensating lookup table 450 is X, the output grayscale OGS may be determined as Equation 3. For example, the output grayscale OGS may be rounded off to the nearest integer.

$$OGS = IGS \times \frac{COMP + \text{OFFSET}}{2^X - 1 + \text{OFFSET}} \quad \text{[Equation 3]}$$

For example, when the minimum luminance LMIN of the display panel 100 is 5048, the maximum luminance LMAX of the display panel may be 10500, the luminance of the first pixel may be 8104 and the number of bits of the compensating lookup table 450 may be 8, the offset is 236 determined by Equation 1. When the first pixel has the luminance of 8104, the compensating grayscale COMP1 of the first pixel may be 70 determined by Equation 2. The output grayscale OGS of the first pixel may be a multiplication of the input grayscale IGS and 0.603.

In the luminance histogram of FIG. 4, the luminances of the pixels are distributed in a luminance area between the minimum luminance LMIN and the maximum luminance LMAX. The luminance area in which the luminances are distributed corresponds to about a half of a full luminance area. In a conventional compensating lookup table which does not employee the offset, the compensating value may have a region between LMIN/LMAX and LMAX/LMAX.

For example, when the minimum luminance LMIN of the display panel 100 is 5048, the maximum luminance LMAX of the display panel 100 may be 10500, the luminance of the first pixel may be 8104 and the number of bits of the compensating lookup table may be eight (8), the conventional lookup table stores values from an eight-bit value of 123 corresponding to 5048/10500 and an eight-bit value of 255 corresponding to 10500/10500. Thus, the conventional lookup table uses about 48% of a total storage. In addition, a compensating resolution of the conventional lookup table may be 1/255, which is about 0.4%.

The compensating lookup table 450 according to the present exemplary embodiment stores the offset commonly applied to all of the pixels and the compensating grayscale COMP individually applied to the pixels. When the number of bits of the compensating lookup table 450 is eight (8), the compensating grayscale COMP may have values from 0 to 255. The compensating lookup table 450 according to the present exemplary embodiment has the compensating resolution of 1/(255+OFFSET), which may be about 0.2%.

According to the present exemplary embodiment, the compensating lookup table 450 stores the offset and the compensating grayscale COMP so that the storage may be efficiently used and the compensating resolution may increase. Thus, the stain of the display panel 100 may be effectively compensated.

Figure 5:
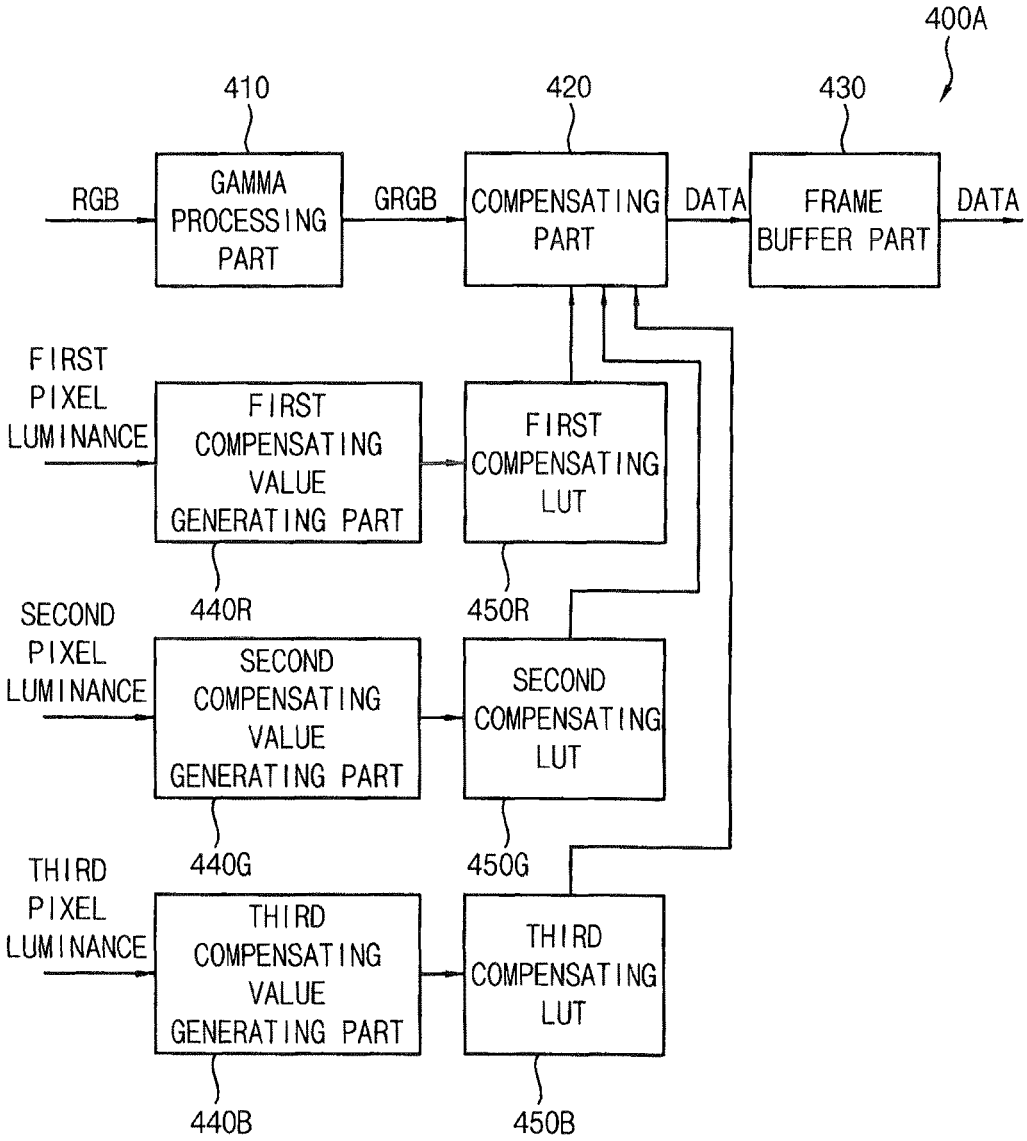
FIG. 5 is a block diagram illustrating a data driver according to example embodiments.
Figure 6A:
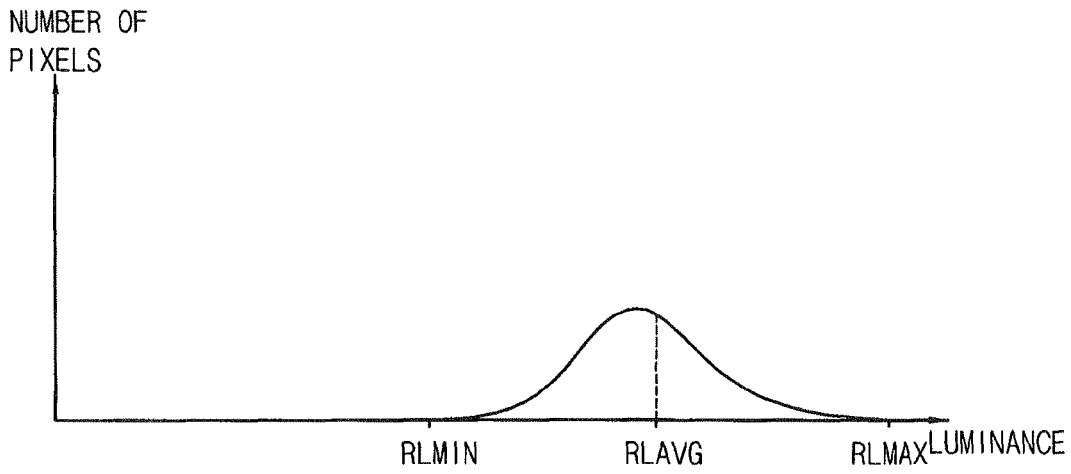
FIG. 6A is a graph illustrating a luminance distribution of a first pixel of FIG. 5.
Figure 6B:
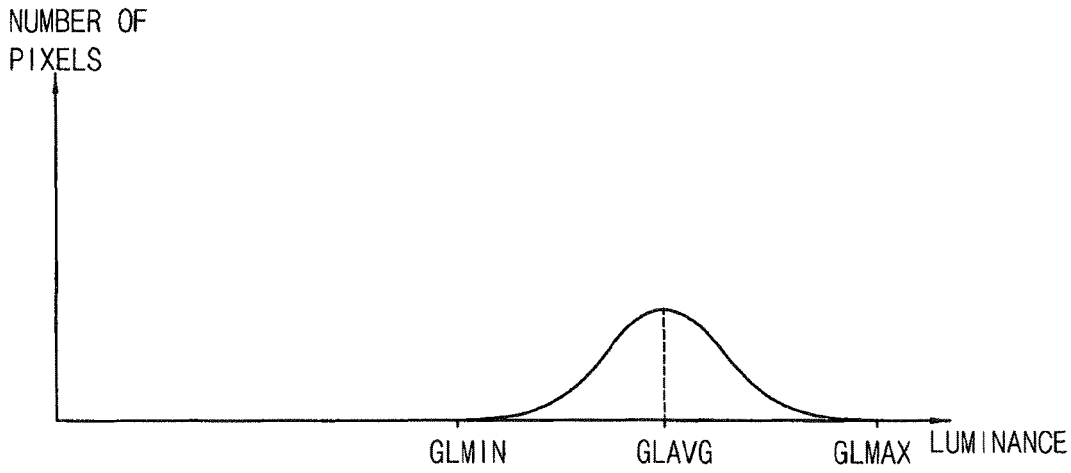
FIG. 6B is a graph illustrating a luminance distribution of a second pixel of FIG. 5.
Figure 6C:
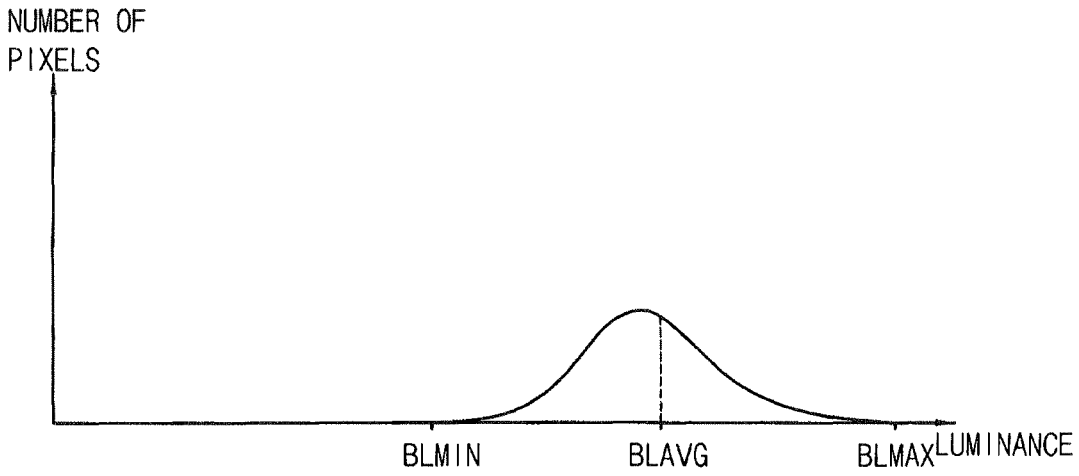
FIG. 6C is a graph illustrating a luminance distribution of a third pixel of FIG. 5.

FIG. 5 is a block diagram illustrating a data driver 400A according to example embodiments. FIG. 6A is a graph illustrating a luminance distribution of a first pixel of FIG. 5. FIG. 6B is a graph illustrating a luminance distribution of a second pixel of FIG. 5. FIG. 6C is a graph illustrating a luminance distribution of a third pixel of FIG. 5.

The display apparatus and the method of driving the display panel of the present example embodiment are substantially the same as the display apparatus and the method of driving the display panel explained referring to FIGS. 1 to 4 except that the display apparatus includes a plurality of the compensating value generating part and a plurality of the compensating lookup tables. Thus, the same reference numerals will be used to refer to the same or like parts as those described in the example embodiments of FIGS. 1 to 4 and any repetitive explanation concerning the above elements will be omitted.

Referring to FIGS. 1, 2, 5 and 6A to 6C, a display apparatus includes a display panel 100 and a display panel driver. The display panel driver includes a controller 200, a gate driver 300 and a data driver 400A.

The data driver 400A includes a gamma processing part 410, a compensating part 420, a frame buffer part 430, a compensating value generating part and a compensating lookup table.

The compensating value generating part includes a first compensating value generating part 440R, a second compensating value generating part 440G and a third compensating value generating part 440B.

The first compensating value generating part 440R receives a luminance histogram of first pixels having a first color. The first compensating value generating part 440R generates a first offset and a first compensating grayscale based on the luminance histogram of first pixels. For example, the first color may be red.

Test image data are inputted to the display panel 100 and the luminance of each first pixel having the first color may be measured to determine the luminance histogram of the first pixels of the display panel 100.

The second compensating value generating part 440G receives a luminance histogram of second pixels having a second color. The second compensating value generating part 440G generates a second offset and a second compensating grayscale based on the luminance histogram of second pixels. For example, the second color may be green.

Test image data are inputted to the display panel 100 and the luminance of each second pixel having the first color may be measured to determine the luminance histogram of the second pixels of the display panel 100.

The third compensating value generating part 440B receives a luminance histogram of third pixels having a third color. The third compensating value generating part 440B generates a third offset and a third compensating grayscale based on the luminance histogram of third pixels. For example, the third color may be blue.

Test image data are inputted to the display panel 100 and the luminance of each third pixel having the first color may be measured to determine the luminance histogram of the third pixels of the display panel 100.

FIGS. 6A to 6C illustrate examples of the luminance histograms of the first to third pixels. The luminances of the first pixels are distributed between a minimum luminance RLMIN and a maximum luminance RLMAX corresponding to the same grayscale. The first pixels have an average luminance RLAVG corresponding to the same grayscale. The luminances of the second pixels are distributed between a minimum luminance GLMIN and a maximum luminance GLMAX corresponding to the same grayscale. The second pixels have an average luminance GLAVG corresponding to the same grayscale. The luminances of the third pixels are distributed between a minimum luminance BLMIN and a maximum luminance BLMAX corresponding to the same grayscale. The third pixels have an average luminance BLAVG corresponding to the same grayscale.

The compensating lookup table includes a first compensating lookup table 450R, a second compensating lookup table 450G and a third compensating lookup table 450B.

The first compensating lookup table 450R stores the first offset and the first compensating grayscale. The second compensating lookup table 450G stores the second offset and the second compensating grayscale. The third compensating lookup table 450B stores the third offset and the third compensating grayscale.

A method of setting the first to third offset may be substantially the same as the method of setting the offset explained referring to FIGS. 1 to 4. A method of setting the first to third compensating grayscale may be substantially the same as the method of setting the compensating grayscale explained referring to FIGS. 1 to 4.

The first offset may be set based on the maximum luminance RLMAX of the first pixels and the minimum luminance RLMIN of the first pixels. For example, the first offset may be commonly applied to all of the first pixels.

The second offset may be set based on the maximum luminance GLMAX of the second pixels and the minimum luminance GLMIN of the second pixels. For example, the second offset may be commonly applied to all of the second pixels.

The third offset may be set based on the maximum luminance BLMAX of the third pixels and the minimum luminance BLMIN of the third pixels. For example, the third offset may be commonly applied to all of the third pixels.

The first compensating grayscale may be set based on the first offset, the minimum luminance RLMIN of the first pixels and the luminance of the first pixel. The first compensating grayscales of the first pixels may be varied according to the luminance of the first pixel.

The second compensating grayscale may be set based on the second offset, the minimum luminance GLMIN of the second pixels and the luminance of the second pixel. The second compensating grayscales of the second pixels may be varied according to the luminance of the second pixel.

The third compensating grayscale may be set based on the third offset, the minimum luminance BLMIN of the third pixels and the luminance of the third pixel. The third compensating grayscales of the third pixels may be varied according to the luminance of the third pixel.

According to the present exemplary embodiment, the compensating lookup table stores the offset and the compensating grayscale COMP so that the storage may be efficiently used and the compensating resolution may increase. Thus, the stain of the display panel 100 may be effectively compensated.

In addition, the offsets and the compensating grayscales for colors of the pixels are stored so that the stain of the display panel 100 may be clearly compensated.

The present inventive concept may be applied to a display panel driver using a lookup table to improve a display quality of the display panel, a display apparatus including the display panel driver and a display system including the display apparatus. For example, the present inventive concept may be applied to an organic light emitting display apparatus and a liquid crystal display apparatus. For example, the present inventive concept may be applied to a cellular phone, a smart phone, a personal digital assistant (PDA), a computer monitor, a laptop, a portable multimedia player (PMP), a television, a digital camera, a MP3 player, a navigation system, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display panel driver, comprising:

a compensating value generating part generating an offset and a compensating grayscale based on luminances of pixels of a display panel;

a compensating lookup table storing the offset and the compensating grayscale; and a compensating part compensating an input grayscale of the pixel to generate a data signal using the compensating lookup table, wherein the offset is set based on a maximum luminance of the pixels and a minimum luminance of the pixels when the same grayscale is applied to the pixels.

2. The display panel driver of claim 1, wherein when the maximum luminance is LMAX, the minimum luminance is LMIN and the number of bits of the compensating lookup table is X, $$\mathrm{OFFSET} = \frac{\frac{LMIN}{LMAX} \times (2^X - 1)}{1 - \frac{LMIN}{LMAX}}.$$

3. The display panel driver of claim 1, wherein the compensating grayscale of a first pixel is set based on the offset, a minimum luminance of the pixels and a luminance of the first pixel.

4. The display panel driver of claim 3, wherein when the offset is OFFSET, the luminance of the first pixel is L1, the minimum luminance is LMIN and the number of bits of the compensating lookup table is X, the compensating grayscale (COMP1) of the first pixel is $$COMP1 = \frac{(2^X - 1 + \text{OFFSET}) \times LMIN}{L1} - \text{OFFSET}.$$

5. The display panel driver of claim 1, wherein when the input grayscale is IGS, the offset is OFFSET, the compensating grayscale is COMP and the number of bits of the compensating lookup table is X, a grayscale (OGS) of the data signal is $$OGS = IGS \times \frac{COMP + \text{OFFSET}}{2^X - 1 + \text{OFFSET}}.$$

6. The display panel driver of claim 1, wherein the compensating value generating part generates a first offset and a first compensating value based on first pixels having a first color, a second offset and a second compensating value based on second pixels having a second color, a third offset and a third compensating value based on third pixels having a third color.

7. A display apparatus, comprising:

a display panel comprising a plurality of gate lines, a plurality of data lines and a plurality of pixels connected to the gate lines and the data lines; and a display panel driver comprising a compensating value generating part generating an offset and a compensating grayscale based on luminances of the pixels, a compensating lookup table storing the offset and the compensating grayscale and a compensating part compensating an input grayscale of the pixel to generate a data signal using the compensating lookup table, wherein the offset is set based on a maximum luminance of the pixels and a minimum luminance of the pixels when the same grayscale is applied to the pixels.

8. The display apparatus of claim 7, wherein the pixel comprises:

a switching transistor including a control electrode connected to the gate line, an input electrode connected to the data line and an output electrode connected to a first node;

a driving transistor including a control electrode connected to the first node, an input electrode connected to a second node and an output electrode connected to a first electrode of an organic light emitting element;

a bias transistor including a control electrode to which a bias voltage is applied, an input electrode to which a high power voltage is applied and an output electrode connected to the second node;

a first capacitor including a first end to which the high power voltage is applied and a second end connected to the first node;

a second capacitor including a first end to which the high power voltage is applied and a second end connected to the control electrode of the bias transistor; and the light organic light emitting element including the first electrode connected to the output electrode of the driving transistor and a second electrode to which a low power voltage is applied.

9. The display apparatus of claim 7, wherein when the maximum luminance is LMAX, the minimum luminance is LMIN and the number of bits of the compensating lookup table is X, $$\text{OFFSET} = \frac{\frac{LMIN}{LMAX} \times (2^X - 1)}{1 - \frac{LMIN}{LMAX}}.$$

10. The display apparatus of claim 7, wherein the compensating grayscale of a first pixel is set based on the offset, a minimum luminance of the pixels and a luminance of the first pixel.

11. The display apparatus of claim 10, wherein when the offset is OFFSET, the luminance of the first pixel is L1, the minimum luminance is LMIN and the number of bits of the compensating lookup table is X, the compensating grayscale (COMP1) of the first pixel is $$COMP1 = \frac{(2^X - 1 + \text{OFFSET}) \times LMIN}{L1} - \text{OFFSET}.$$

12. The display apparatus of claim 7, wherein when the input grayscale is IGS, the offset is OFFSET, the compensating grayscale is COMP and the number of bits of the compensating lookup table is X, a grayscale (OGS) of the data signal is $$OGS = IGS \times \frac{COMP + \text{OFFSET}}{2^X - 1 + \text{OFFSET}}.$$

13. The display apparatus of claim 7, wherein the compensating value generating part generates a first offset and a first compensating value based on first pixels having a first color, a second offset and a second compensating value based on second pixels having a second color, a third offset and a third compensating value based on third pixels having a third color.

14. A method of driving a display panel, the method comprising:

generating an offset and a compensating grayscale based on luminances of pixels of a display panel;

storing the offset and the compensating grayscale in a compensating lookup table; and compensating an input grayscale of the pixel to generate a data signal using the compensating lookup table, wherein the offset is set based on a maximum luminance of the pixels and a minimum luminance of the pixels when the same grayscale is applied to the pixels.

15. The method of claim 14, wherein the compensating grayscale of a first pixel is set based on the offset, a minimum luminance of the pixels and a luminance of the first pixel.

16. The method of claim 14, wherein when the input grayscale is IGS, the offset is OFFSET, the compensating grayscale is COMP and the number of bits of the compensating lookup table is X, a grayscale (OGS) of the data signal is $$OGS = IGS \times \frac{COMP + \text{OFFSET}}{2^X - 1 + \text{OFFSET}}.$$

17. The method of claim 14, wherein the storing the offset and the compensating grayscale comprises:

generating a first offset and a first compensating value based on first pixels having a first color;

generating a second offset and a second compensating value based on second pixels having a second color; and generating a third offset and a third compensating value based on third pixels having a third color.

* * * * *